US008534943B2

(12) United States Patent
Lupton

(10) Patent No.: US 8,534,943 B2
(45) Date of Patent: Sep. 17, 2013

(54) LOTION APPLICATOR

(76) Inventor: Barbara Anne Lupton, Burlington (CA)

( * ) Notice: Subject to any disclaimer, the term of this patent is extended or adjusted under 35 U.S.C. 154(b) by 284 days.

(21) Appl. No.: 12/903,308

(22) Filed: Oct. 13, 2010

(65) Prior Publication Data

US 2012/0093561 A1 Apr. 19, 2012

(51) Int. Cl.
*A46B 5/02* (2006.01)

(52) U.S. Cl.
USPC ..... 401/6

(58) Field of Classification Search
USPC ..... 401/6, 48, 131; 15/222, 160
See application file for complete search history.

(56) References Cited

U.S. PATENT DOCUMENTS

| | | | | |
|---|---|---|---|---|
| 4,299,005 | A | 11/1981 | Brown | |
| 4,483,356 | A | 11/1984 | Kales | |
| 5,013,171 | A * | 5/1991 | Almond, II | 401/6 |
| 5,035,523 | A * | 7/1991 | Allinder | 401/6 |
| 5,251,990 | A * | 10/1993 | Vought et al. | 401/8 |
| 5,269,037 | A | 12/1993 | While | |
| 5,360,111 | A | 11/1994 | Arispe | |
| 5,388,700 | A | 2/1995 | Per-Lee | |
| 5,437,372 | A | 8/1995 | Per-Lee | |
| 5,566,418 | A | 10/1996 | Steffen | |
| 5,628,083 | A | 5/1997 | Hayes | |
| 5,736,213 | A | 4/1998 | Meier | |
| 6,026,531 | A * | 2/2000 | Pruitt | 15/160 |
| D440,355 | S * | 4/2001 | Nati | D28/63 |
| 6,851,154 | B1 | 2/2005 | Neff | |
| 7,168,873 | B2 | 1/2007 | Shawan et al. | |
| 7,410,318 | B2 | 8/2008 | Chambers et al. | |
| 7,661,897 | B1 | 2/2010 | Jackson | |

FOREIGN PATENT DOCUMENTS

| | | | |
|---|---|---|---|
| GB | 2407495 | A | 5/2005 |
| WO | 00/62641 | A1 | 10/2000 |

OTHER PUBLICATIONS

PCT/CA2011/001141 Search Report dated Jan. 6, 2012.
PCT/CA2011/001141—Written Opinion dated Jan. 6, 2012.

* cited by examiner

*Primary Examiner* — David Walczak
(74) *Attorney, Agent, or Firm* — Perry + Currier Inc.; Kristjan Spence

(57) ABSTRACT

An apparatus for applying lotion, comprising a smooth, non-absorbent sheet for receiving lotion on an inner surface thereof; a first flexible handle extending from one corner to another corner of one side of the sheet; and a second flexible handle extending from one corner to another of an opposing side of the sheet, the first and second handles being arranged for receiving the arms of a user therethrough.

8 Claims, 6 Drawing Sheets

LOTION APPLICATOR

FIELD

The specification relates to an apparatus for applying lotion or other fluids to a user's body.

BACKGROUND

It can sometimes be desirable to apply a lotion, ointment or other fluid—common examples of such fluids include sunscreen and moisturizer—to one or more parts of the body. Some body parts, however, can be difficult to reach without assistance. For example, it can be challenging for even a healthy, able-bodied person to apply lotion to their own back. For those with limited range of motion in the arms due to injury or age, applying lotion to one's own back can be a difficult, if not impossible, task.

BRIEF DESCRIPTIONS OF THE DRAWINGS

Figure 1:
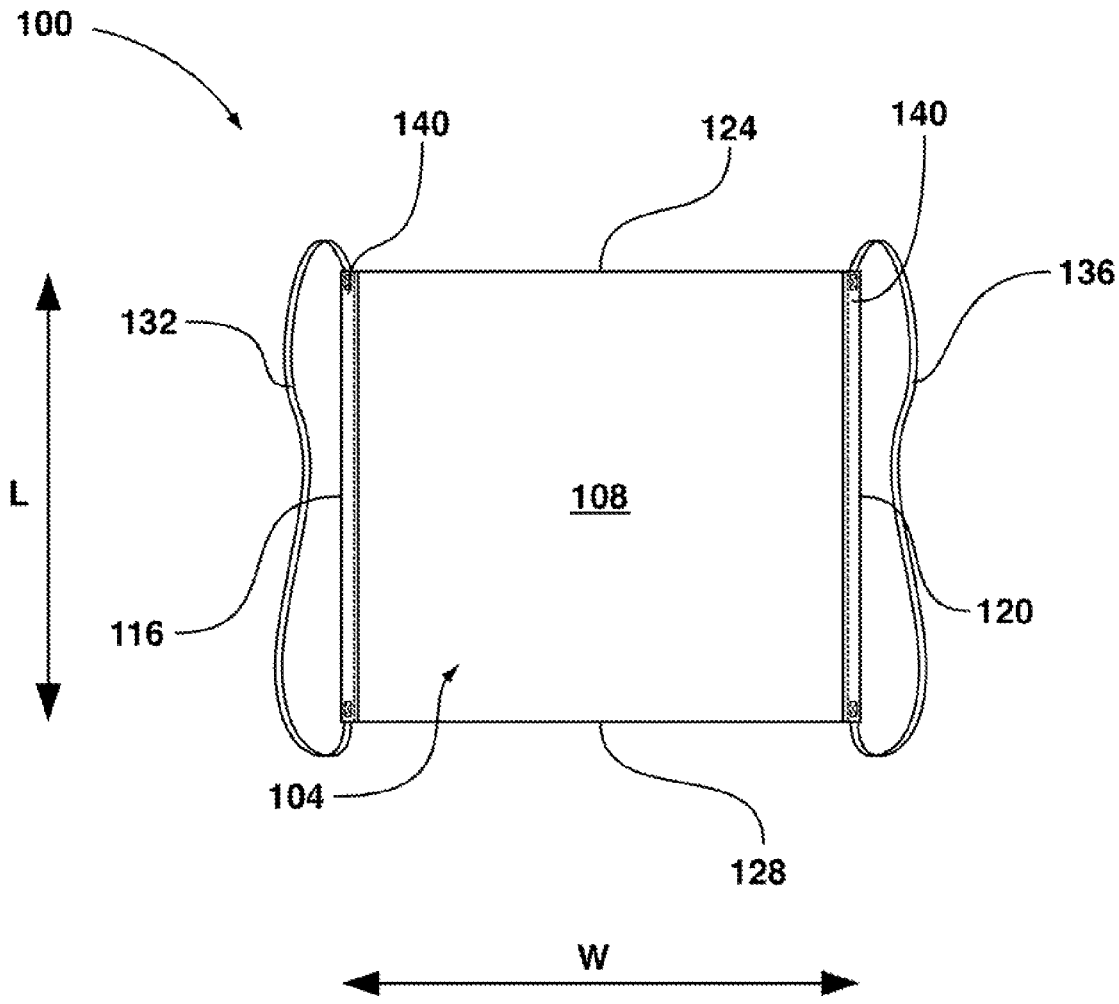

Embodiments are described with reference to the following figures, in which:

FIG. 1 depicts a lotion applicator, according to a non-limiting embodiment; and FIGS. 2-6 depict a method of applying lotion with the lotion applicator of FIG. 1, according to a non-limiting embodiment.

DETAILED DESCRIPTION OF THE EMBODIMENTS

A first broad aspect of an embodiment seeks to provide a lotion applicator, comprising a smooth, non-absorbent sheet for receiving lotion on an inner surface thereof; a first flexible handle extending from one corner to another corner of one side of the sheet; and a second flexible handle extending from one corner to another of an opposing side of the sheet, the first and second handles being arranged for receiving the arms of a user therethrough.

FIG. 1 depicts a lotion applicator 100 according to a non-limiting embodiment. Lotion applicator 100 includes a base, or sheet, 104. Sheet 104, can be a rectangular or substantially rectangular piece of flexible, smooth, non-absorbent material. Sheet 104 has an outer surface 108 and an inner surface 112 (opposite outer surface 108 and therefore not visible in FIG. 1). Sheet 104 also has substantially parallel opposing left and right edges, or sides, 116 and 120, respectively. Sheet 104 also includes substantially parallel opposing top and bottom edges, or sides 124 and 128, respectively. It will be understood that left and right edges 116 and 120 are substantially perpendicular to top and bottom edges 124 and 128.

Lotion application 100 further includes a flexible left handle 132 and a flexible right handle 136. Left and right handles 132 and 136 can extend from the top corners to the bottom corners of opposing sides of sheet 104. That is, left handle extends from the top-left corner (i.e. the juncture between top side 124 and left side 116) to the bottom-left corner (i.e. the juncture between bottom side 128 and left side 116). Meanwhile, right handle extends from the top-right corner (i.e. the juncture between top side 124 and right side 120) to the bottom-right corner (i.e. the juncture between bottom side 128 and right side 120). Thus, left and right handles 132 and 136 extend along opposing sides of sheet 104. As seen in FIG. 1, each of the left and right handles 132 and 136 have a length that is greater than that of corresponding left and right sides 116 and 120. As a result, a space is provided between each handle and its corresponding side of sheet 104. The space provided is large enough to accommodate an arm of a user, as will be discussed in greater detail below.

A method of applying lotion to a user's back with lotion applicator 100 will now be discussed in connection with FIGS. 2-6. The following discussion of the use of lotion applicator 100 will also serve to provide further insight as to the structure of lotion applicator 100. This description of the use of lotion applicator 100 is non-limiting—it will be understood that lotion applicator 100 can be used to apply lotion, or any other suitably viscous fluid, to any part of a user's body.

Figure 2:
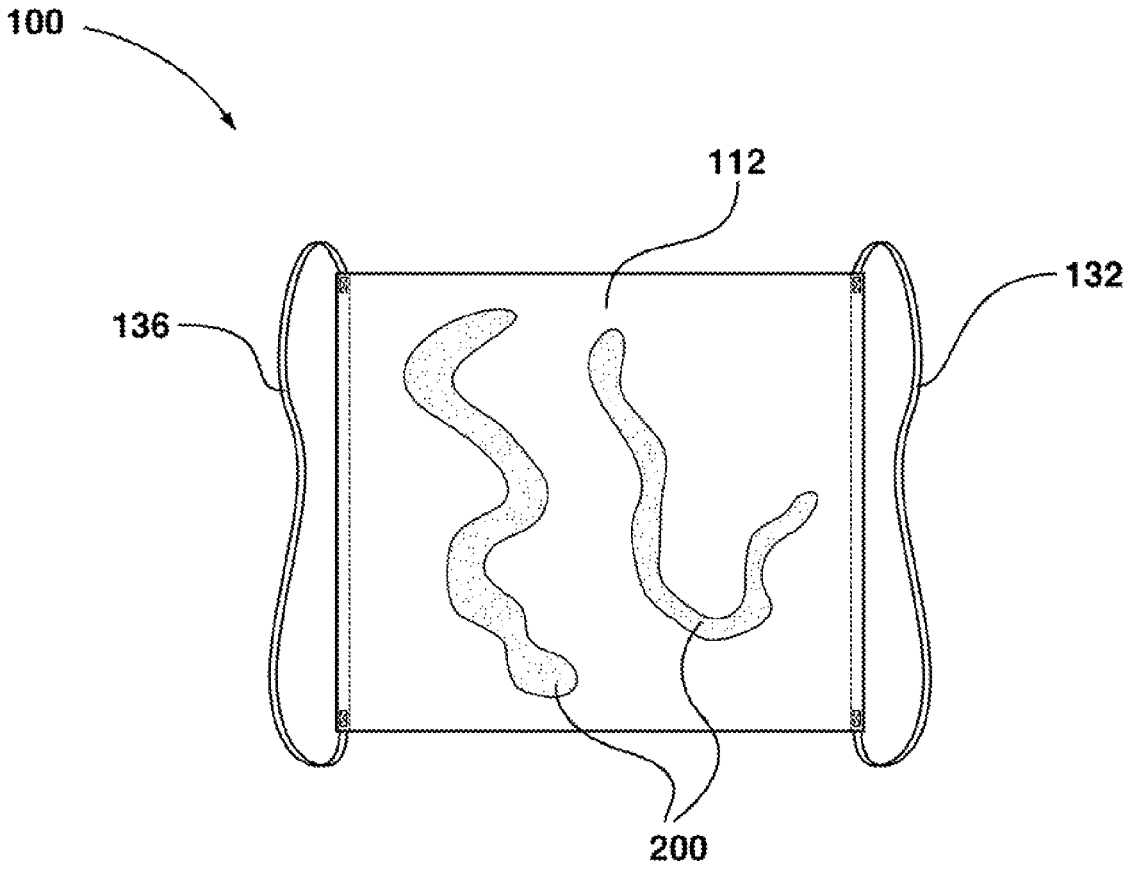
Figure 3:
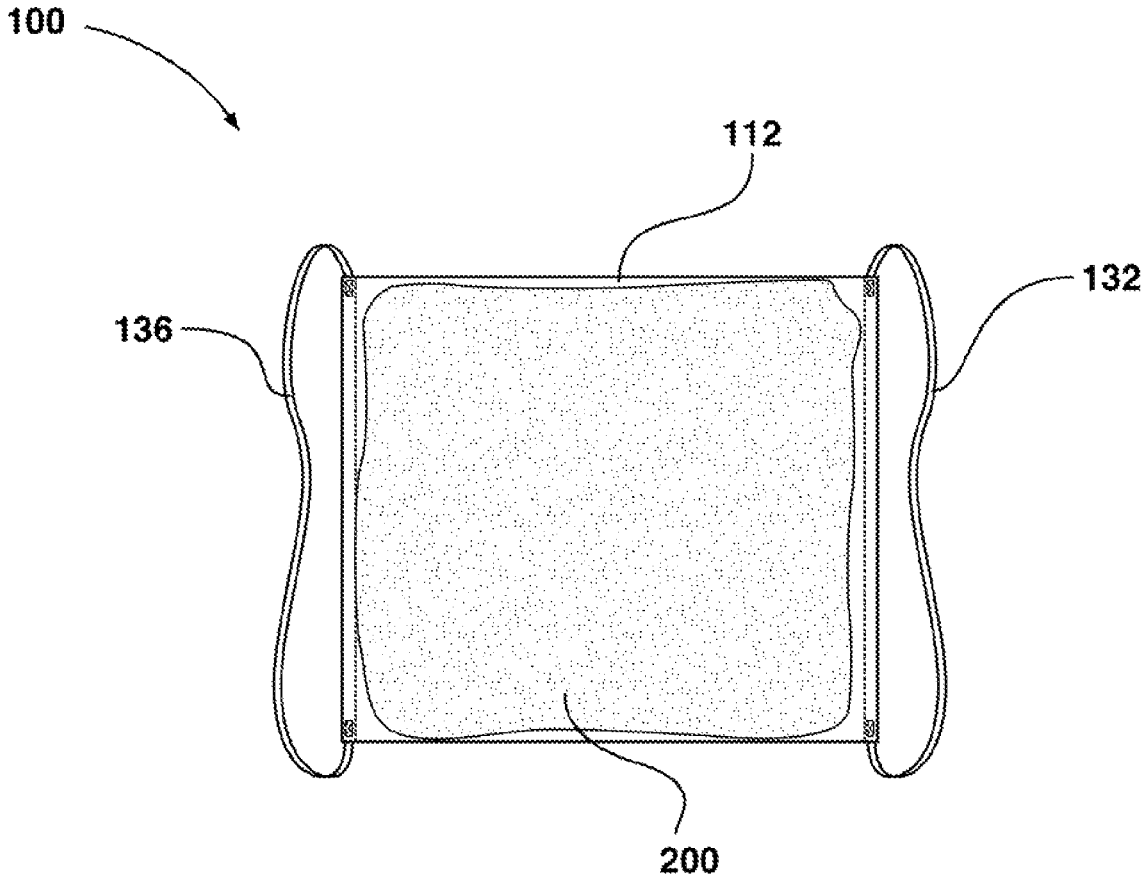

Referring now to FIG. 2, lotion applicator 100 is shown as being turned over. That is, while outer surface 108 faced the reader in FIG. 1, inner surface 112 now faces the reader in FIG. 2. As a result, left handle 132 appears on the right of FIG. 2, while right handle 136 appears on the left of FIG. 2. In preparing lotion applicator 100 for use, a suitable amount of lotion 200 is applied to inner surface 112 from a lotion receptacle (not shown) such as a bottle.

Following application of lotion 200 to inner surface 112, lotion 200 can be spread evenly over inner surface 112. Lotion 200 is spread over the majority (i.e. at least half) of inner surface 112. For example, in the example embodiment shown in FIG. 3, lotion 200 is spread over approximately three quarters of the total area of inner surface 112. Lotion 200 can be spread on inner surface 112 in a variety of ways. For example, lotion 200 can be spread by the hand of a user, or by folding sheet 104 and rubbing the folded portions of inner surface 112 against each other.

Figure 4:
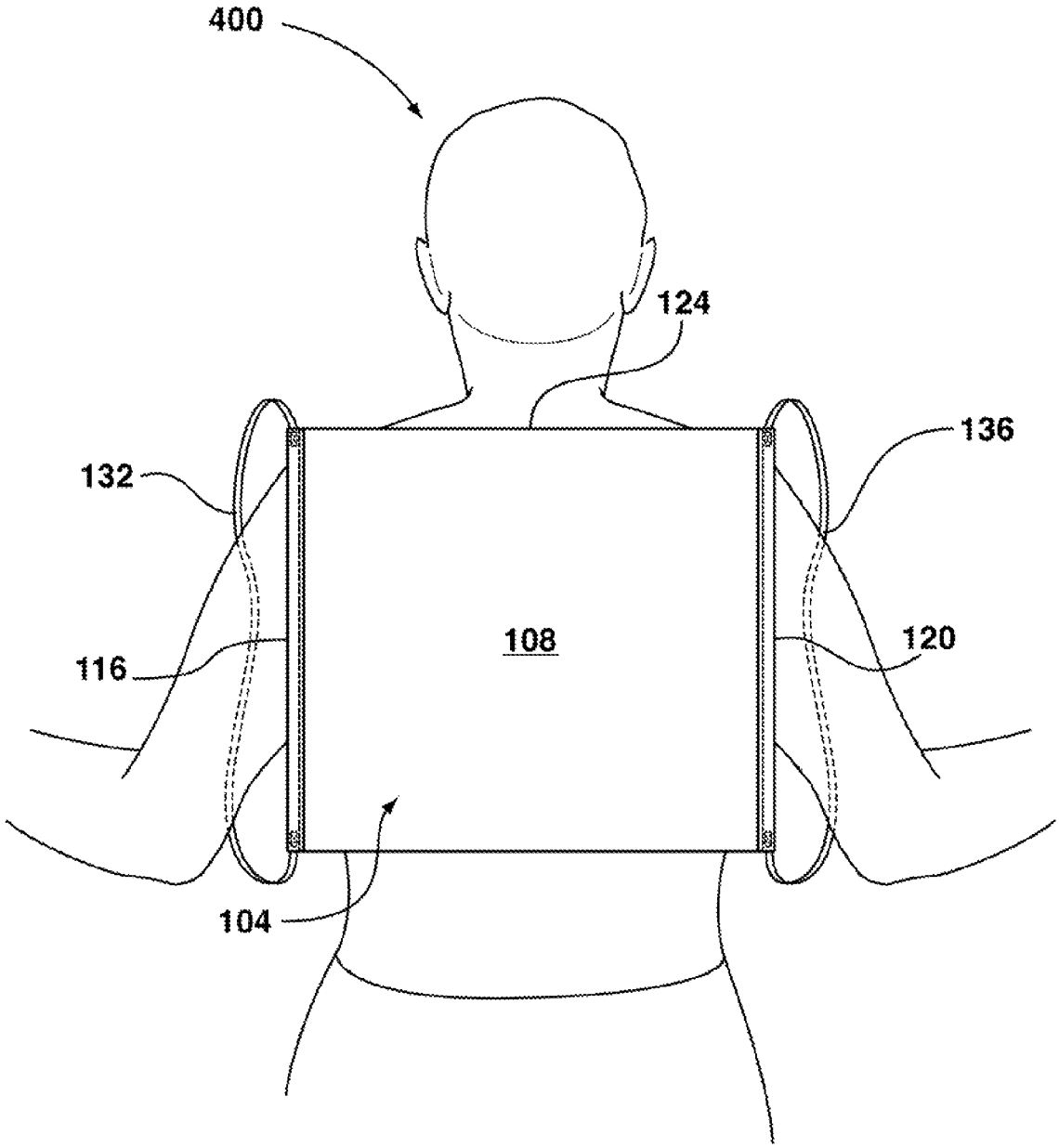

Referring now to FIG. 4, use of lotion applicator 100 continues with the equipping of lotion applicator 100 by a user 400. Figure illustrates the back side of user 400. Thus, it can be seen that lotion applicator 100, in the present example embodiment, is applied to the back of user 400. It will now be apparent that references herein to terms such as "top", "bottom", "left" and "right" are made in relation to the position of lotion applicator 100 as seen in FIG. 4. In other words, left edge 116 is the edge of lotion applicator which is on the left side of user 400 when lotion applicator 100 is applied to user 400's back. Left handle 132 is therefore the handle through which user 400's left arm is received when lotion applicator 100 is applied to user 400's back. Top edge 124 is the substantially horizontal edge that is closer to user 400's head, while bottom edge 128 is the substantially horizontal edge that is further from user 400's head. In addition, it will also now be apparent that the use of the terms "inner" and "outer" also relate to the use of lotion applicator as illustrated in FIG. 4. In particular, inner surface 112 refers to the surface closest to the back of user 400, while outer surface 108 refers to the opposite surface furthest from user 400's back. Thus, inner surface 112 is not visible in FIG. 4 as it is "behind" outer surface 108, lying against user 400's back.

Also apparent from FIG. 4 is that the space between left handle 132 and left edge 116 of sheet 104 is sufficiently large to receive user 400's left arm therethrough. Similarly, the space defined between right handle 136 and right edge 120 of sheet 104 is sufficiently large to receive user 400's right arm therethrough. When the left and right arms of user 400 are received through the openings defined between left and right handles 132 and 136 and the edges of sheet 104, sheet 104 lays across the upper back of user 400, with the left and right corners of the upper edge 124 of sheet 104 being proximal to the left and right shoulders of user 400, respectively. If necessary, user 400 can grasp the left and right upper corners to adjust the position of sheet 104. User 400 can also, if necessary, grasp the lower corners of sheet 104 or left and right handles 132 and 136 near the lower corners, to flatten sheet 104 against the back of user 400.

Figure 5:
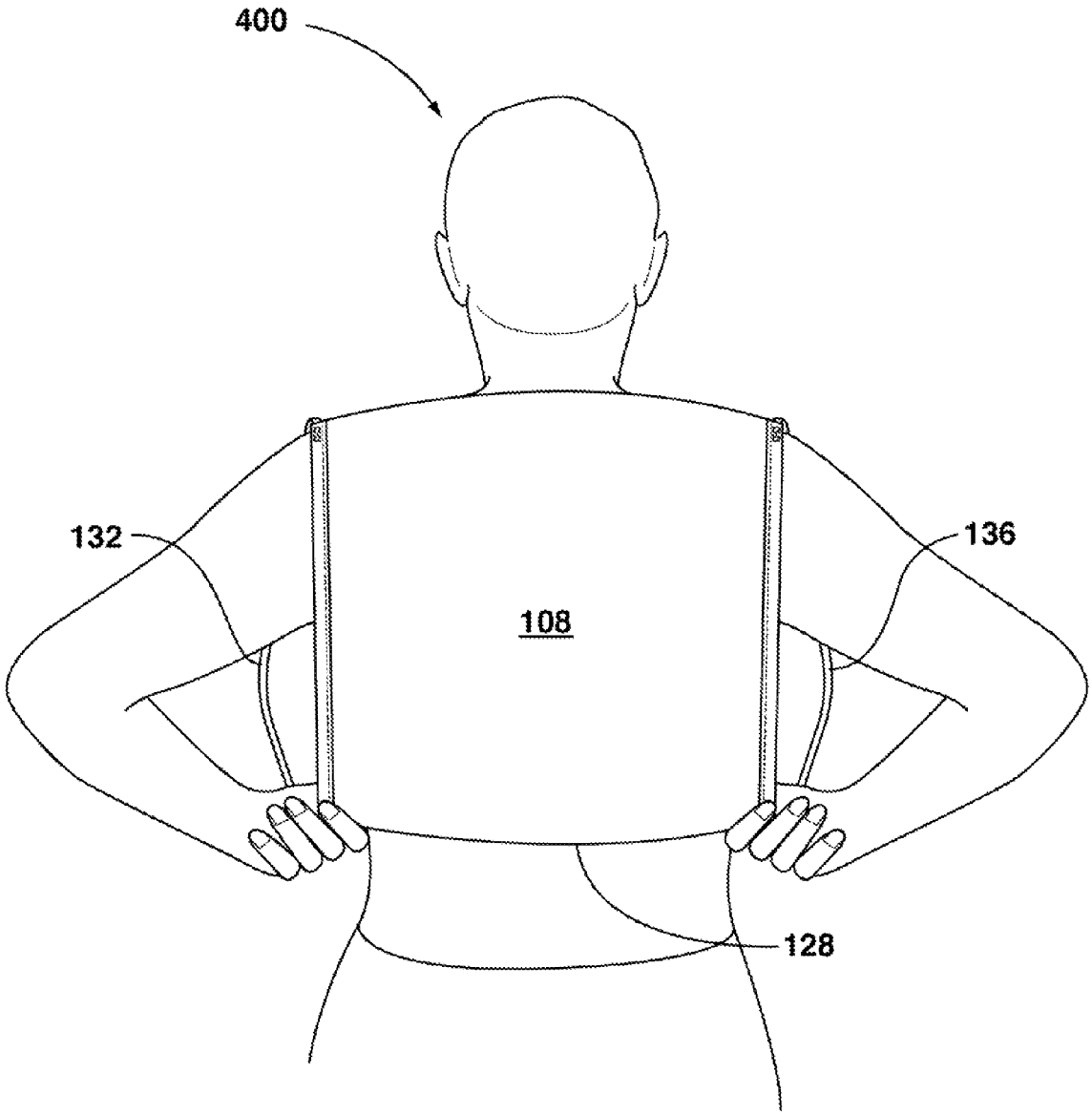

Proceeding to FIG. 5, following placement of inner surface 112 against user 400's back and receipt of user 400's left and right arms through left and right handles 132 and 136, respectively, left and right handles 132 and 136 can be grasped by user 400 for application of a downward force. Left and right handles 132 and 136 can be grasped by user 400's left and right hands, respectively, at any suitable point along the length of the handles 132 and 136. In general, left and right handles 132 and 136 will each be grasped at a point that will allow lotion applicator 100 to be pulled in a downward direction, as will be discussed below. Thus, left and right handles 132 and 136 can be grasped between their mid-points and bottom ends, and are preferably grasped near or at their respective bottom ends (that is, near the left and right bottom corners of sheet 104), as shown in FIG. 5. It will be appreciated that the point at which left and right handles 132 and 136 can be grasped will depend in part on the length of left and right handles 132 and 136. In order to allow for lotion applicator 100 to be pulled downwardly, the point at which handles 132 and 136 are grasped must be lower on user 400's body than bottom edge 128 of sheet 104. In some embodiments, it may be desirable to grasp sheet 104 itself near the bottom left and right corners rather than grasping left and right handles 132 and 136.

Figure 6:
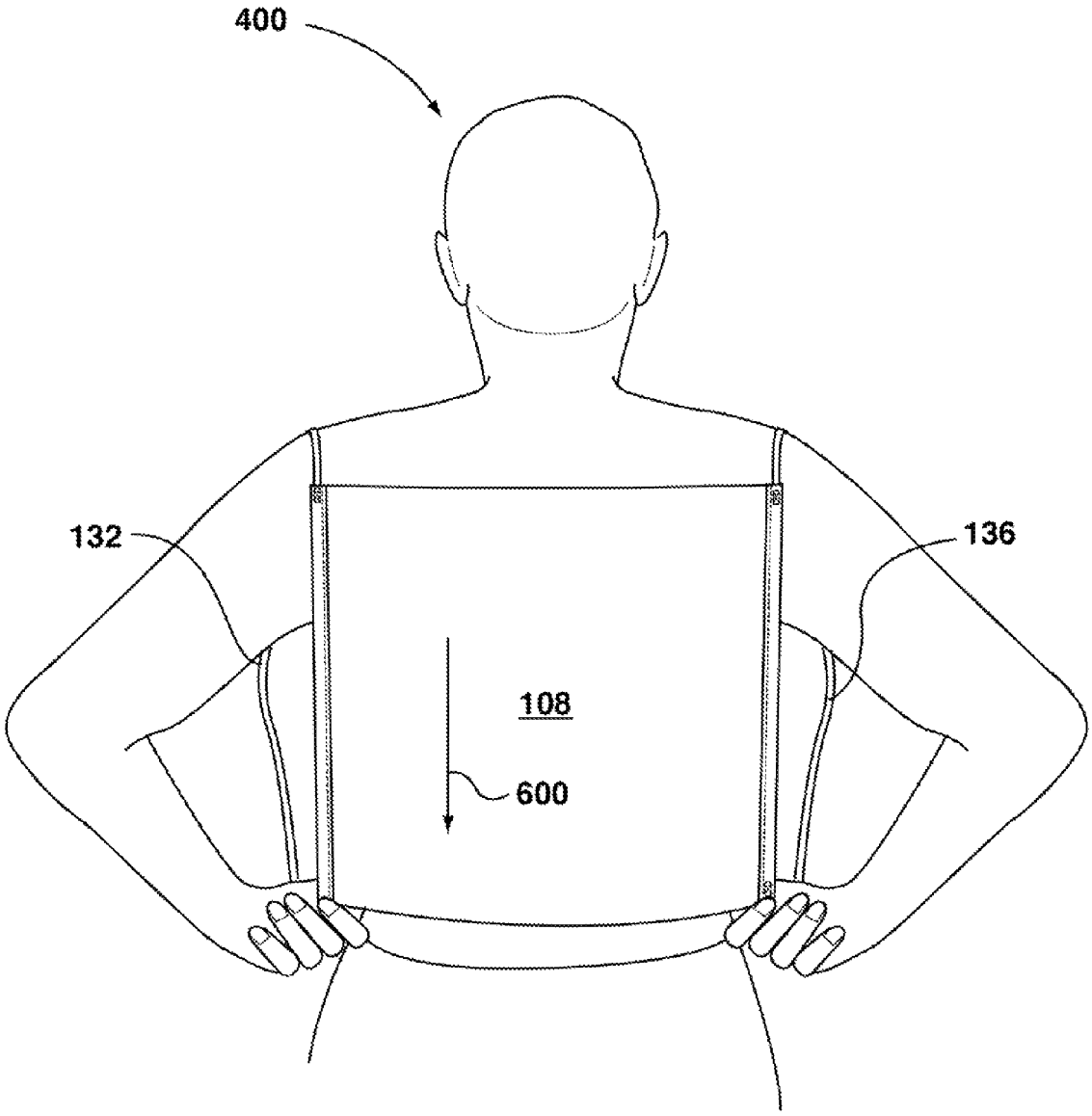

Referring now to FIG. 6, lotion applicator 100 is pulled downwardly along the back of user 400, in the direction of arrow 600. As a result of the movement of lotion applicator 100, at least a portion of lotion 200 which was applied to inner surface 112 earlier is transferred to user 400's back. Lotion applicator 100 can then be removed from user 400. As can be seen in FIG. 6, during the downwards motion of sheet 104 along user 400's back, handles 132 and 136 extend over user 400's shoulders and act to keep sheet 104 against user 400's back.

Based on the above description of the use of lotion applicator 100, and referring back to FIG. 1, it will also now be apparent that sheet 104 can have a length, "L", that is approximately equal to the width, "W" of sheet 104. This is not a necessity, however. In general, the width W of sheet 104 should be such that sheet 104 extends substantially from one side of user 400's back to the other, without necessitating lateral motion of lotion applicator 100 in order to adequately apply lotion to user 400's back. Length L of sheet 104 can be smaller or greater than W, but should not be less than one quarter of W and should not be greater than the length of user 400's back. In the present example embodiment, L is approximately 80% of W, and is approximately three quarters of the length of user 400's back. It will be appreciated that lotion applicator 100 can therefore be manufactured in a variety of shapes and sizes.

It will also be apparent to those skilled in the art that various materials are suitable for sheet 104 and handles 132 and 136. In the presently described example embodiment, sheet 104 can be a single layer of polyester and polyvinyl. In particular, sheet 104 can have a composition of approximately 36% polyester and 64% polyvinyl. In general, any material that is non-absorbent and smooth, such that lotion does not become embedded in topographical features of the material, is suitable for use. Preferably, the material used has a weight sufficiently high to prevent wrinkling during the sliding motion shown in FIG. 6, but sufficiently low to allow for ease of use and storage. Materials that are machine-washable are preferable.

Handles 132 and 136 can be any of a variety of strings, cords and the like. Materials which are non-absorbent and machine-washable are preferable. In the presently described example embodiment, handles 132 and 136 can each be made of vinyl and have a diameter of approximately 3 mm. Handles 132 and 136 can be attached to sheet 104 by way of a seam 140 along each of left and right edges 116 and 120. Each seam 140 can be manufactured by folding over a portion of sheet 104 and fastening the folded portion to the remainder of sheet 104, by means such as sewing, glue or heat-sealing and the like. However the seam 140 is assembled, each end of handles 132 and 136 can be inserted into the seam prior to final fastening of the seam. Seams 140, if present, preferably involve folding material onto outer surface 108 rather than inner surface 112. Handles 132 and 136 can also be resizable in some embodiments. For example, each one of handles 132 and 136 can comprise two portions. A first portion can be coupled to a top corner and a second portion can be coupled to a bottom corner. The two portions can be fastened to each other at different points to provide a desired length during use. Other means of adjusting the length of handles 132 and 136 will also occur to those skilled in the art.

Certain advantages associated with the use of lotion applicator 100 will now occur to those skilled in the art. For example, the dimensions and structural arrangement of the components of lotion applicator 100 result in the requirement of only a single, relatively small motion for user 400 to successfully apply lotion to all, or substantially all, of user 400's back.

Further advantages include, for example, ease of storage and cleaning. The flexibility of sheet 104 and handles 132 and 136 allow for lotion applicator 100 to be readily folded for storage after use. Further, the use of a single sheet of smooth, non-absorbent material reduces the likelihood of undesirable fluid build-up between uses, which could lead to undesirable bacterial build-up. Other advantages will also occur to those skilled in the art.

Persons skilled in the art will appreciate that there are yet more alternative implementations and modifications possible for implementing the embodiments, and that the above implementations and examples are only illustrations of one or more embodiments. The scope, therefore, is only to be limited by the claims appended hereto.

I claim:

1. A method of using a lotion applicator having a smooth, non-absorbent sheet, a first flexible handle extending from one corner to another corner of one side of the sheet, and a second flexible handle extending from one corner to another of an opposing side of the sheet, the method comprising:

applying lotion on an inner surface of the smooth, non-absorbent sheet;

extending respective arms of a user through the first and second flexible handles such that the first and second handles rest on respective shoulders of the user and such that the inner surface lies against an upper portion of a back of the user; and applying a downward force to the lotion applicator for sliding the sheet downwards along the back of the user such that the inner surface slides from the upper portion to a lower portion of the back of the user.

2. The method of claim 1 wherein the first flexible handle extends from a top-left corner of the sheet to a bottom-left corner of the sheet, and wherein the second flexible handle extends from a top-right corner of the sheet to a bottom-right corner of the sheet.

3. The method of claim 2, wherein the sheet is substantially rectangular, having a length and a width.

4. The method of claim 3, wherein the length is approximately three quarters of the width.

5. The method of claim 3, wherein the width is approximately equal to the width of the back of the user.

6. The method of claim 2 wherein applying the downward force comprises applying downward forces to each of the first and second handles.

7. The method of claim 2 wherein applying the downward force comprises applying downward forces to each of the bottom-left and bottom-right corners of the sheet.

8. The method of claim 1 wherein the handles extend over the shoulders of the user for retaining the inner surface of the sheet against the back of the user during application of the downward force.

* * * * *